US009204227B2

(12) United States Patent
Woods

(10) Patent No.: US 9,204,227 B2
(45) **Date of Patent: *Dec. 1, 2015**

(54) NOISE REDUCTION SYSTEM FOR HEARING ASSISTANCE DEVICES

(71) Applicant: Starkey Laboratories, Inc., Eden Prairie, MN (US)

(72) Inventor: William S. Woods, Berkeley, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,104

(22) Filed: Feb. 24, 2014

(65) Prior Publication Data

US 2014/0348359 A1 Nov. 27, 2014

Related U.S. Application Data

(63) Continuation of application No. 12/649,648, filed on Dec. 30, 2009, now Pat. No. 8,737,653.

(51) Int. Cl.
*H04R 25/00* (2006.01)

(52) U.S. Cl.
CPC ..... *H04R 25/453* (2013.01); *H04R 25/552* (2013.01); *H04R 2225/49* (2013.01); *H04R 2410/01* (2013.01); *H04R 2410/05* (2013.01)

(58) Field of Classification Search
CPC ..... H04R 25/43; H04R 25/70; H04R 25/353; H04R 25/356; H04R 25/453; H04R 25/505; H04R 25/552; H04R 2225/43; H04R 2225/49
USPC ..... 381/23.1, 312–331; 704/500
See application file for complete search history.

(56) References Cited

U.S. PATENT DOCUMENTS 3,527,901 A 9/1970 Geib
3,571,514 A 3/1971 Wruk
3,770,911 A 11/1973 Knowles et al.

(Continued)

FOREIGN PATENT DOCUMENTS

CH 673551 A5 3/1990
EP 0789474 A2 8/1997

(Continued)

OTHER PUBLICATIONS

"U.S. Appl. No. 09/052,631, Final Office Action mailed Jul. 11, 2000", 8 pgs.

(Continued)

*Primary Examiner* — Matthew Eason
(74) *Attorney, Agent, or Firm* — Schwegman Lundberg & Woessner, P.A.

(57) ABSTRACT

Disclosed herein is a system for binaural noise reduction for hearing assistance devices using information generated at a first hearing assistance device and information received from a second hearing assistance device. In various embodiments, the present subject matter provides a gain measurement for noise reduction using information from a second hearing assistance device that is transferred at a lower bit rate or bandwidth by the use of coding for further quantization of the information to reduce the amount of information needed to make a gain calculation at the first hearing assistance device. The present subject matter can be used for hearing aids with wireless or wired connections.

20 Claims, 4 Drawing Sheets

(56) References Cited

U.S. PATENT DOCUMENTS

| | | | |
|---|---|---|---|
| 3,798,390 | A | 3/1974 | Gage et al. |
| 3,836,732 | A | 9/1974 | Johanson et al. |
| 3,875,349 | A | 4/1975 | Ruegg |
| 3,894,196 | A | 7/1975 | Briskey |
| 3,946,168 | A | 3/1976 | Preves |
| 3,975,599 | A | 8/1976 | Johanson |
| 4,051,330 | A | 9/1977 | Cole |
| 4,142,072 | A | 2/1979 | Berland |
| 4,366,349 | A | 12/1982 | Adelman |
| 4,396,806 | A | 8/1983 | Anderson |
| 4,419,544 | A | 12/1983 | Adelman |
| 4,449,018 | A | 5/1984 | Stanton |
| 4,456,795 | A | 6/1984 | Saito |
| 4,471,490 | A | 9/1984 | Bellafiore |
| 4,622,440 | A | 11/1986 | Slavin |
| 4,637,402 | A | 1/1987 | Adelman |
| 4,712,244 | A | 12/1987 | Zwicker et al. |
| 4,723,293 | A | 2/1988 | Harless |
| 4,751,738 | A | 6/1988 | Widrow et al. |
| 4,882,762 | A | 11/1989 | Waldhauer |
| 5,029,215 | A | 7/1991 | Miller, II |
| 5,214,709 | A | 5/1993 | Ribic |
| 5,226,087 | A | 7/1993 | Ono et al. |
| 5,289,544 | A | 2/1994 | Franklin |
| 5,390,254 | A | 2/1995 | Adelman |
| 5,434,924 | A | 7/1995 | Jampolsky |
| 5,479,522 | A | 12/1995 | Lindemann et al. |
| 5,483,599 | A | 1/1996 | Zagorski |
| 5,502,769 | A | 3/1996 | Gilbertson |
| 5,524,056 | A | 6/1996 | Killion et al. |
| 5,553,152 | A | 9/1996 | Newton |
| 5,581,747 | A | 12/1996 | Anderson |
| 5,651,071 | A | 7/1997 | Lindemann et al. |
| 5,659,621 | A | 8/1997 | Newton |
| 5,721,783 | A | 2/1998 | Anderson |
| 5,734,976 | A | 3/1998 | Bartschi et al. |
| 5,757,932 | A | 5/1998 | Lindemann et al. |
| 5,757,933 | A | 5/1998 | Preves et al. |
| 5,822,442 | A | 10/1998 | Agnew et al. |
| 5,825,631 | A | 10/1998 | Prchal |
| 5,835,611 | A | 11/1998 | Kaiser et al. |
| 5,852,668 | A | 12/1998 | Ishige et al. |
| 5,862,238 | A | 1/1999 | Agnew et al. |
| 5,991,419 | A | 11/1999 | Brander |
| 6,041,129 | A | 3/2000 | Adelman |
| 6,078,825 | A | 6/2000 | Hahn et al. |
| 6,144,748 | A | 11/2000 | Kerns |
| 6,157,728 | A | 12/2000 | Tong et al. |
| 6,236,731 | B1 | 5/2001 | Brennan et al. |
| 6,240,192 | B1 | 5/2001 | Brennan et al. |
| 6,311,155 | B1 | 10/2001 | Vaudrey et al. |
| 6,347,148 | B1 | 2/2002 | Brennan et al. |
| 6,366,863 | B1 | 4/2002 | Bye et al. |
| 6,381,308 | B1 | 4/2002 | Cargo et al. |
| 6,389,142 | B1 | 5/2002 | Hagen et al. |
| 6,449,662 | B1 | 9/2002 | Armitage |
| 6,549,633 | B1 | 4/2003 | Westermann |
| 6,633,645 | B2 | 10/2003 | Bren et al. |
| 6,760,457 | B1 | 7/2004 | Bren et al. |
| 7,103,191 | B1 | 9/2006 | Killion |
| 7,116,792 | B1 | 10/2006 | Taenzer et al. |
| 7,139,404 | B2 | 11/2006 | Feeley et al. |
| 7,369,669 | B2 | 5/2008 | Hagen et al. |
| 7,561,707 | B2 | 7/2009 | Kornagel |
| 7,590,253 | B2 | 9/2009 | Killion |
| 7,822,217 | B2 | 10/2010 | Hagen et al. |
| 8,041,066 | B2 | 10/2011 | Solum |
| 8,208,642 | B2 | 6/2012 | Edwards |
| 8,515,114 | B2 | 8/2013 | Solum |
| 8,737,653 | B2 | 5/2014 | Woods |
| 2001/0007050 | A1 | 7/2001 | Adelman |
| 2002/0006206 | A1 | 1/2002 | Scofield |
| 2002/0076073 | A1 | 6/2002 | Taenzer et al. |
| 2002/0090099 | A1 | 7/2002 | Hwang |
| 2002/0131614 | A1 | 9/2002 | Jakob et al. |
| 2002/0186857 | A1 | 12/2002 | Bren et al. |
| 2003/0045283 | A1 | 3/2003 | Hagedoorn |
| 2003/0059073 | A1 | 3/2003 | Bren et al. |
| 2003/0133582 | A1 | 7/2003 | Niederdrank |
| 2003/0215106 | A1 | 11/2003 | Hagen et al. |
| 2004/0010181 | A1 | 1/2004 | Feeley et al. |
| 2004/0052391 | A1 | 3/2004 | Bren et al. |
| 2004/0077387 | A1 | 4/2004 | Sayag et al. |
| 2005/0160270 | A1 | 7/2005 | Goldberg et al. |
| 2006/0018497 | A1 | 1/2006 | Kornagel |
| 2006/0039577 | A1 | 2/2006 | Sanguino et al. |
| 2006/0068842 | A1 | 3/2006 | Sanguino et al. |
| 2006/0093172 | A1 | 5/2006 | Ludvigsen et al. |
| 2006/0193273 | A1 | 8/2006 | Passier et al. |
| 2006/0198529 | A1 | 9/2006 | Kjems et al. |
| 2006/0205349 | A1 | 9/2006 | Passier et al. |
| 2006/0274747 | A1 | 12/2006 | Duchscher et al. |
| 2007/0149261 | A1 | 6/2007 | Huddart |
| 2008/0008341 | A1 | 1/2008 | Edwards |
| 2008/0159548 | A1 | 7/2008 | Solum |
| 2008/0273727 | A1 | 11/2008 | Hagen et al. |
| 2008/0306745 | A1* | 12/2008 | Roy et al. ..... 704/500 |
| 2011/0158442 | A1 | 6/2011 | Woods |
| 2012/0121094 | A1 | 5/2012 | Solum |
| 2012/0308019 | A1 | 12/2012 | Edwards |
| 2014/0177885 | A1 | 6/2014 | Solum |

FOREIGN PATENT DOCUMENTS

| | | | |
|---|---|---|---|
| EP | 1185138 | A2 | 3/2002 |
| EP | 1365628 | A2 | 11/2003 |
| EP | 1174003 | B1 | 7/2004 |
| EP | 1519625 | A2 | 3/2005 |
| EP | 1531650 | A2 | 5/2005 |
| EP | 1670283 | A1 | 6/2006 |
| EP | 1715718 | A2 | 10/2006 |
| EP | 1365628 | B1 | 12/2011 |
| EP | 1879426 | B1 | 8/2013 |
| WO | WO-9641498 | A1 | 12/1996 |
| WO | WO-0021332 | A2 | 4/2000 |
| WO | WO-0158064 | A1 | 8/2001 |
| WO | WO-0167433 | A1 | 9/2001 |
| WO | WO-0203750 | A2 | 1/2002 |
| WO | WO-0209363 | A2 | 1/2002 |
| WO | WO-0223950 | A2 | 3/2002 |
| WO | WO-2004034738 | A1 | 4/2004 |
| WO | WO-2004100607 | A1 | 11/2004 |
| WO | WO-2004110099 | A2 | 12/2004 |
| WO | WO-2005009072 | A2 | 1/2005 |
| WO | WO-2005101731 | A2 | 10/2005 |
| WO | WO-2006023857 | A1 | 3/2006 |
| WO | WO-2006023920 | A1 | 3/2006 |
| WO | WO-2006133158 | A1 | 12/2006 |

OTHER PUBLICATIONS

"U.S. Appl. No. 09/052,631, Final Office Action mailed Jul. 30, 2001", 5 pgs.
"U.S. Appl. No. 09/052,631, Non Final Office Action mailed Jan. 18, 2001", 6 pgs.
"U.S. Appl. No. 09/052,631, Non Final Office Action mailed Dec. 28, 1999", 10 pgs.
"U.S. Appl. No. 09/052,631, Notice of Allowance mailed Dec. 18, 2001", 6 pgs.
"U.S. Appl. No. 09/052,631, Response filed May 18, 2001 to Non Final Office Action mailed Jan. 18, 2001", 7 pgs.
"U.S. Appl. No. 09/052,631, Response filed Oct. 30, 2001 to Final Office Action mailed Jul. 30, 2001", 5 pgs.
"U.S. Appl. No. 09/052,631, Response filed Nov. 10, 2000 to Final Office Action mailed Jul. 11, 2000", 5 pgs.
"U.S. Appl. No. 10/146,536, Advisory Action mailed Oct. 16, 2007", 5 pgs.
"U.S. Appl. No. 10/146,536, Final Office Action mailed May 18, 2007", 28 pgs.
"U.S. Appl. No. 10/146,536, Non-Final Office Action mailed Sep. 19, 2006", 26 pgs.
"U.S. Appl. No. 10/146,536, Non-Final Office Action mailed Dec. 16, 2005", 25 pgs.

(56) References Cited

OTHER PUBLICATIONS

"U.S. Appl. No. 10/146,536, Notice of Allowance mailed Dec. 27, 2007", 10 pgs.
"U.S. Appl. No. 10/146,536, Response filed Feb. 20, 2007 to Non-Final Office Action mailed Sep. 19, 2006", 20 pgs.
"U.S. Appl. No. 10/146,536, Response filed Jun. 16, 2006 to Non-Final Office Action mailed Dec. 16, 2005", 14 pgs.
"U.S. Appl. No. 10/146,536, Response filed Nov. 19, 2007 to Final Office Action mailed May 18, 2007", 19 pgs.
"U.S. Appl. No. 10/146,536, Response filed Sep. 18, 2007 to Final Office Action dated Jun. 18, 2007", 24 pgs.
"U.S. Appl. No. 11/456,538, Final Office Action mailed Mar. 3, 2011", 28 pgs.
"U.S. Appl. No. 11/456,538, Non-Final Office Action mailed Aug. 19, 2010", 25 Pgs.
"U.S. Appl. No. 11/456,538, Notice of Allowance mailed Apr. 5, 2012", 10 pgs.
"U.S. Appl. No. 11/456,538, Notice of Allowance mailed May 16, 2012", 10 pgs.
"U.S. Appl. No. 11/456,538, Notice of Allowance Mailed Dec. 19, 2011", 9 pgs.
"U.S. Appl. No. 11/456,538, Response filed Jan. 19, 2011 to Non Final Office Action mailed Aug. 19, 2010", 16 pgs.
"U.S. Appl. No. 11/456,538, Response filed Aug. 5, 2011 to Final Office Action mailed Mar. 3, 2011", 15 pgs.
"U.S. Appl. No. 11/619,541, Non Final Office Action mailed Dec. 21, 2010", 7 pgs.
"U.S. Appl. No. 11/619,541, Notice of Allowance mailed Jul. 5, 2011", 6 pgs.
"U.S. Appl. No. 11/619,541, Response filed May 23, 2011 to Non Final Office Action mailed Dec. 21, 2010", 10 pgs.
"U.S. Appl. No. 12/115,423, Notice of Allowance mailed Sep. 15, 2010", 9 pgs.
"U.S. Appl. No. 12/649,648 , Response filed Jun. 5, 2013 to Non Final Office Action mailed Mar. 5, 2013", 9 pgs.
"U.S. Appl. No. 12/649,648 , Response filed Nov. 13, 2013 to Final Office Action mailed Sep. 13, 2013", 9 pgs.
"U.S. Appl. No. 12/649,648, Final Office Action mailed Sep. 13, 2013", 16 pgs.
"U.S. Appl. No. 12/649,648, Non Final Office Action mailed Mar. 5, 2013", 15 pgs.
"U.S. Appl. No. 12/649,648, Notice of Allowance mailed Nov. 22, 2013", 7 pgs.
"U.S. Appl. No. 13/270,860, Non Final Office Action mailed Dec. 18, 2012", 5 pgs.
"U.S. Appl. No. 13/270,860, Notice of Allowance mailed Apr. 17, 2013", 10 pgs.
"U.S. Appl. No. 13/270,860, Preliminary Amendment filed Jan. 27, 2012", 7 pgs.
"U.S. Appl. No. 13/270,860, Response filed Mar. 18, 2013 to Non Final Office Action mailed Dec. 18, 2012", 7 pgs.
"Canadian Application Serial No. 2,428,908, Office action mailed Mar. 15, 2007", 6 pgs.
"Canadian Application Serial No. 2,428,908, Office action mailed Nov. 4, 2008", 9 pgs.
"Canadian Application Serial No. 2,428,908, Response filed Sep. 17, 2007 to Office Action mailed Mar. 15, 2007", 25 pgs.
"European Application Serial No. 03253052, European Search Report mailed Nov. 24, 2005", 2 pgs.
"European Application Serial No. 03253052.9, European Search Report mailed Nov. 24, 2005", 2 pgs.
"European Application Serial No. 03253052.9, Office Action mailed Mar. 26, 2009", 3 pgs.
"European Application Serial No. 03253052.9, Response filed Oct. 5, 2009 to Office Action mailed Mar. 26, 2009", 25 pgs.
"European Application Serial No. 07252582.7, Extended European Search Report mailed Apr. 4, 2008", 7 pgs.
"European Application Serial No. 07252582.7, Office Action Mailed Feb. 6, 2009", 2 pgs.
"European Application Serial No. 07252582.7, Office Action mailed Dec. 27, 2011", 4 pgs.
"European Application Serial No. 07252582.7, Response filed Apr. 20, 2011 to Office Action mailed Oct. 15, 2010", 4 pgs.
"European Application Serial No. 07252582.7, Response filed Apr. 27, 2012 to Office Action mailed Dec. 27, 2011", 3 pgs.
"European Application Serial No. 07252582.7, Response filed Aug. 11, 2009 to Office Communication mailed Feb. 6, 2009", 2 pgs.
"European Application Serial No. 07252582.7.0, Office Action mailed Oct. 15, 2010", 4 pgs.
"European Application Serial No. 07254947.0, Extended European Search Report mailed Apr. 3, 2008", 6 pgs.
"European Application Serial No. 07254947.0, Office Action mailed Aug. 25, 2008", 1 pgs.
"European Application Serial No. 07254947.0, Office Action mailed Jan. 19, 2012", 5 pgs.
"European Application Serial No. 07254947.0, Office Action mailed Oct. 12, 2010", 4 pgs.
"European Application Serial No. 07254947.0, Response filed Apr. 26, 2011 to Official Communication mailed Oct. 12, 2010", 11 pgs.
"European Application Serial No. 07254947.0, Response filed Jul. 20, 2012 to Examination Notification Art. 94(3) mailed Jan. 19, 2012", 9 pgs.
"European Application Serial No. 07254947.0, Response filed Feb. 28, 2009 to Official Communication mailed Aug. 25, 2008", 2 pgs.
"European Application Serial No. 10252192.9, Extended European Search Report mailed Jan. 2, 2013", 8 pgs.
"Kleer Announces Reference Design for Wireless Earphones", [Online]. Retrieved from the Internet: <URL:http://kleer.com/newsevents/press_releases/prjan2.php>, (Jan. 2, 2007), 2 pgs.
"Technical Data Sheet—Microphone Unit 6903", Published by Microtronic, (Dec. 2000), 2 pgs.
Birger, Kollmeier, et al., "Real-time multiband dynamic compression and noise reduction for binaural hearing aids", Journal of Rehabilitation Research and Developement, vol. 30, No. 1, (Jan. 1, 1993), 82-94.
Davis, A., et al., "Magnitude of Diotic Summation in Speech-in-Noise Tasks: Performance Region and Appropriate Baseline", British Journal of Audiology, 24, (1990), 11-16.
Greefkes, J. A, et al., "Code Modulation with Digitally Controlled Companding for Speech Transmission", Philips Tech. Rev., 31(11/12), (1970), 335-353.
Griffing, Terry S, et al., "Acoustical Efficiency of Canal ITE Aids", Audecibel, (1983), 30-31.
Griffing, Terry S, et al., "Custom canal and mini in-the-ear hearing aids", Hearing Instruments, vol. 34, No. 2, (Feb. 1983), 31-32.
Griffing, Terry S, et al., "How to evaluate, sell, fit and modify canal aids", Hearing Instruments, vol. 35, No. 2, (Feb. 1984), 3 pgs.
Haartsen, J., "Bluetooth—The Universal Radio Interface for Ad Hoc, Wireless Connectivity", Ericsson Review, No. 3, (1998), 110-117.
Halverson, H. M., "Diotic Tonal Volumes as a Function of Difference of Phase", The American Journal of Psychology, 33(4), (Oct. 1922), 526-534.
Lindemann, "Two microphone nonlinear frequency domain beamformer for hearing aid noise reduction", IEEE ASSP Workshop on Applications of Signal Processing to Audio and Acoustics, (Oct. 1995), 24-27.
Lindemann, Eric, "Two Microphone Nonlinear Frequency Domain Beamformer for Hearing Aid Noise Reduction", Proc. IEEE Workshop on Applications of Signal Processing to Audio and Acoustics, (1995), 24-27.
Mahon, William J, "Hearing Aids Get a Presidential Endorsement", The Hearing Journal,, (Oct. 1983), 7-8.
Olivier, Roy, "Distributed Signal Processing for Binaural Hearing Aid", [Online]. Retrieved from Internet<http://infoscience.epfl.ch/record/126277/files/EPFL TH4220.pdf?version=1>, (Jan. 1, 2008), 1-143.
Olivier, Roy, et al., "Rate-Constrained Collaborative Noise Reduction for Wireless Hearing Aid", IEEE Transactions on signal Processing, IEEE Service center, New York, NY, US, vol. 57, No. 2, (Feb. 1, 2009), 645-657.

(56) References Cited

OTHER PUBLICATIONS

Peissig, J., et al., "Directivity of binaural noise reduction in spatial multiple noise-source arrangements for normal and impaired listeners", J Acoust Soc Am., 101(3), (Mar. 1997), 1660-70.
Preves, D. A., "A Look at the Telecoil—Its Development and Potential", SHHH Journal, (Sep./Oct. 1994), 7-10.
Preves, David A., "Field Trial Evaluations of a Switched Directional/Omnidirectional In-the-Ear Hearing Instrument", Journal of the American Academy of Audiology, 10(5), (May 1999), 273-283.
Srinivasan, S., "Low-bandwidth binaural beamforming", IEEE Electronics Letters, 44(22), (Oct. 23, 2008), 1292-1293.
Srinivasan, Sriram, et al., "Beamforming under Quantization Errors in Wireless Binaural Hearing Aids", EURASIP Journal on Audio, Speech, and Music Processing, vol. 2008, Article ID 824797, (Jan. 28, 2008), 8 pgs.
Sullivan, Roy F, "Custom canal and concha hearing instruments: A real ear comparison Part I", Hearing Instruments, vol. 40, No. 4, (Jul. 1989), 23-29.
Sullivan, Roy F, "Custom canal and concha hearing instruments: A real ear comparison Part II", Hearing Instruments, vol. 40, No. 7, (Jul. 1989), 30-36.
Teder, Harry, "Something New in CROS", Hearing Instruments, vol. 27, No. 9, Published by Harcourt Brace Jovanovich, (Sep. 1976), 18-19.
Vivek, Goyal K, "Theoretical Foundations of Transform Coding", IEEE Single Processing Magazine, IEEE Service center, Piscataway, NJ, US, vol. 18, No. 5, (Sep. 1, 2001), 9-21.
Zelnick, E., "The Importance of Interaural Auditory Differences in Binaural Hearing", Binaural Hearing and Amplification, vol. 1, (1980), 81-103.
"U.S. Appl. No. 13/464,419, Notice of Allowance mailed Jan. 16, 2015", 10 pgs.
"U.S. Appl. No. 13/464,419, Preliminary Amendment filed Apr. 25, 2014", 8 pgs.
"U.S. Appl. No. 13/970,368, Preliminary Amendment mailed Mar. 6, 2014", 6 pgs.
"European Application Serial No. 03253052.9, Communication of Notice of Opposition mailed Sep. 24, 2012", 22 pgs.
"European Application Serial No. 03253052.9, Communication of Notice of Opposition mailed Oct. 23, 2012", 1 pgs.
"European Application Serial No. 03253052.9, EPO Brief Communication mailed Oct. 17, 2014", 6 pgs.
"European Application Serial No. 03253052.9, Response filed May 2, 2013 to Notice of Opposition mailed Sep. 24, 2012", 36 pgs.
"European Application Serial No. 03253052.9, Summons to Attend Oral Proceedings Mailed Mar. 13, 2014", 7 pgs.
"European Application Serial No. 03253052.9, Written Submission filed Oct. 13, 2014", 12 pgs.
"European Application Serial No. 07254947.0, Summons to Attend Oral Proceedings mailed Nov. 7, 2014", 3 pgs.
"European Application Serial No. 10252192.9, Response filed Jul. 18, 2013 to Extended European Search Report mailed Jan. 2, 2013".
US 8,175,281, 05/2012, Edwards (withdrawn)

* cited by examiner

NOISE REDUCTION SYSTEM FOR HEARING ASSISTANCE DEVICES

PRIORITY APPLICATION

This application is a continuation of and claims the benefit of priority under 35 U.S.C. §120 to U.S. patent application Ser. No. 12/649,648, filed on 30 Dec. 2009, which application is incorporated herein by reference in its entirety.

TECHNICAL FIELD

This disclosure relates generally to hearing assistance devices, and more particularly to a noise reduction system for hearing assistance devices.

BACKGROUND

Hearing assistance devices, such as hearing aids, include, but are not limited to, devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification.

Hearing aids employ different forms of amplification to achieve improved hearing. However, with improved amplification comes a need for noise reduction techniques to improve the listener's ability to hear amplified sounds of interest as opposed to noise.

Many methods for multi-microphone noise reduction have been proposed. Two methods (Peissig and Kollmeier, 1994, 1997, and Lindemann, 1995, 1997) propose binaural noise reduction by applying a time-varying gain in left and right channels (i.e., in hearing aids on opposite sides of the head) to suppress jammer-dominated periods and let target-dominated periods be presented unattenuated. These systems work by comparing the signals at left and right sides, then attenuating left and right outputs when the signals are not similar (i.e., when the signals are dominated by a source not in the target direction), and passing them through unattenuated when the signals are similar (i.e., when the signals are dominated by a source in the target direction). To perform these methods as taught, however, requires a high bit-rate interchange between left and right hearing aids to carry out the signal comparison, which is not practical with current systems. Thus, a method for performing the comparison using a lower bit-rate interchange is needed.

Roy and Vetterli (2008) teach encoding power values in frequency bands and transmitting them rather than the microphone signal samples or their frequency band representations. One of their approaches suggests doing so at a low bitrate through the use of a modulo function. This method may not be robust, however, due to violations of the assumptions leading to use of the modulo function. In addition, they teach this toward the goal of reproducing the signal from one side of the head in the instrument on the other side, rather than doing noise reduction with the transmitted information.

Srinivasan (2008) teaches low-bandwidth binaural beamforming through limiting the frequency range from which signals are transmitted. We teach differently from this in two ways: we teach encoding information (Srinivasan teaches no encoding of the information before transmitting); and, we teach transmitting information over the whole frequency range.

Therefore, an improved system for improved intelligibility without a degradation in natural sound quality in hearing assistance devices is needed.

SUMMARY

Disclosed herein, among other things, is a system for binaural noise reduction for hearing assistance devices using information generated at a first hearing assistance device and information received from a second hearing assistance device. In various embodiments, the present subject matter provides a gain measurement for noise reduction using information from a second hearing assistance device that is transferred at a lower bit rate or bandwidth by the use of coding for further quantization of the information to reduce the amount of information needed to make a gain calculation at the first hearing assistance device. The present subject matter can be used for hearing aids with wireless or wired connections.

In various embodiments, the present subject matter provides examples of a method for noise reduction in a first hearing aid configured to benefit a wearer's first ear using information from a second hearing aid configured to benefit a wearer's second ear, comprising: receiving first sound signals with the first hearing aid and second sound signals with the second hearing aid; converting the first sound signals into first side complex frequency domain samples (first side samples); calculating a measure of amplitude of the first side samples as a function of frequency and time ($A_1(f,t)$); calculating a measure of phase in the first side samples as a function of frequency and time ($P_1(f,t)$); converting the second sound signals into second side complex frequency domain samples (second side samples); calculating a measure of amplitude of the second side samples as a function of frequency and time ($A_2(f,t)$); calculating a measure of phase in the second side samples as a function of frequency and time ($P_2(f,t)$); coding the $A_2(f,t)$ and $P_2(f,t)$ to produce coded information; transferring the coded information to the first hearing aid at a bit rate that is reduced from a rate necessary to transmit the measure of amplitude and measure of phase prior to coding; converting the coded information to original dynamic range information; and using the original dynamic range information, $A_1(f,t)$ and $P_1(f,t)$ to calculate a gain estimate at the first hearing aid to perform noise reduction. In various embodiments the coding includes generating a quartile quantization of the $A_2(f,t)$ and/or the $P_2(f,t)$ to produce the coded information. In some embodiments the coding includes using parameters that are adaptively determined or that are predetermined.

Other conversion methods are possible without departing from the scope of the present subject matter. Different encodings may be used for the phase and amplitude information. Variations of the method includes further transferring the first device coded information to the second hearing aid at a bit rate that is reduced from a rate necessary to transmit the measure of amplitude and measure of phase prior to coding; converting the first device coded information to original dynamic range first device information; and using the original dynamic range first device information, $A_2(f,t)$ and $P_2(f,t)$ to calculate a gain estimate at the second hearing aid to perform noise reduction. In variations, subband processing is performed. In variations continuously variable slope delta modulation coding is used.

The present subject matter also provides a hearing assistance device adapted for noise reduction using information from a second hearing assistance device, comprising: a microphone adapted to convert sound into a first signal; a processor adapted to provide hearing assistance device processing and adapted to perform noise reduction calculations, the processor configured to perform processing comprising: frequency analysis of the first signal to generate frequency domain complex representations; determine phase and amplitude information from the complex representations; convert coded phase and amplitude information received from the second hearing assistance device to original dynamic range information; and compute a gain estimate from the phase and amplitude information and form the original dynamic range information. Different wireless communications are possible to transfer the information from one hearing assistance device to another. Variations include different hearing aid applications.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
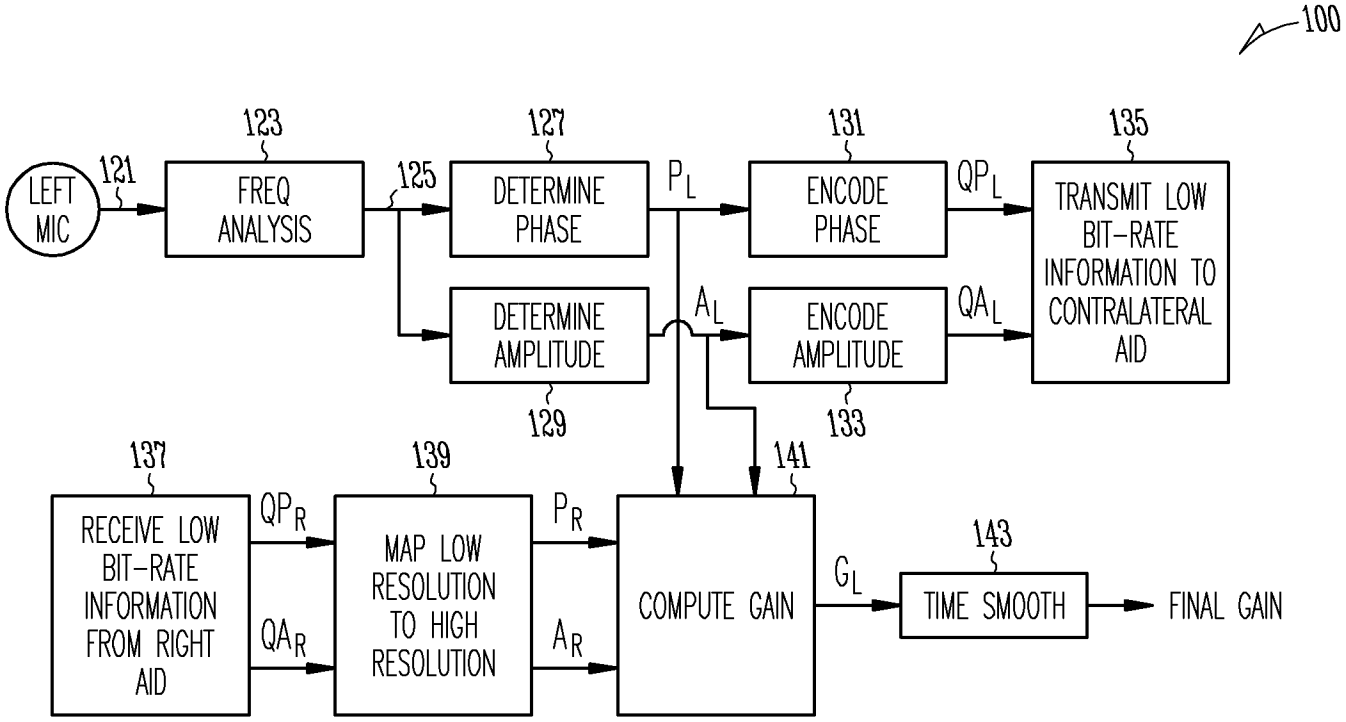
FIG. 1A is a flow diagram of a binaural noise reduction system for a hearing assistance device according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to improved binaural noise reduction in in a hearing assistance device using a lower bit rate data transmission method from one ear to the other for performing the noise reduction.

The current subject matter includes embodiments providing the use of low bit-rate encoding of the information needed by the Peissig/Kollmeier and Lindemann noise reduction algorithms to perform their signal comparison. The information needed for the comparison in a given frequency band is the amplitude and phase angle in that band. Because the information is combined to produce a gain function that can be heavily quantized (e.g. 3 gain values corresponding to no attenuation, partial attenuation, and maximum attenuation) and then smoothed across time to produce effective noise reduction, the transmitted information itself need not be high-resolution. For example, the total information in a given band and time-frame could be transmitted with 4 bits, with amplitude taking 2 bits and 4 values (high, medium, low, and very low), and phase angle in the band taking 2 bits and 4 values (first, second, third, or fourth quadrant). In addition, if smoothed before transmitting it might be possible to transmit the low resolution information in a time-decimated fashion (i.e., not necessarily in each time-frame).

Peissig and Kollmeier (1994, 1997) and Lindemann (1995, 1997) teach a method of noise suppression that requires full resolution signals be exchanged between the two ears. In these methods the gain in each of a plurality of frequency bands is controlled by several variables compared across the right and left signals in each band. If the signals in the two bands are very similar, then the signals at the two ears are likely coming from the target direction (i.e., directly in front) and the gain is 0 dB. If the two signals are different, then the signals at the two ears are likely due to something other than a source in the target direction and the gain is reduced. The reduction in gain is limited to some small value, such as −20 dB. In the Lindemann case, when no smoothing is used the gain in a given band is computed using the following equation:

$$A_L(t) = \sqrt{\mathrm{Re}^2\{X_L(t)\} + \mathrm{Im}^2\{X_L(t)\}}$$

$$A_R(t) = \sqrt{\mathrm{Re}^2\{X_R(t)\} + \mathrm{Im}^2\{X_R(t)\}}$$

$$P_L(t) = \tan^{-1}\left[\frac{\mathrm{Im}\{X_L(t)\}}{\mathrm{Re}\{X_L(t)\}}\right]$$

$$P_R(t) = \tan^{-1}\left[\frac{\mathrm{Im}\{X_R(t)\}}{\mathrm{Re}\{X_R(t)\}}\right]$$

$$G(t) = \max\left\{G_{mib}, \left[\frac{2 \cdot A_L(t) \cdot A_R(t) \cdot \cos(P_L(t) - P_R(t))}{A_L^2(t) + A_R^2(t)}\right]^s\right\},$$

where t is a time-frame index, $X_L$ and $X_R$ are the high-resolution signals in each band, L and R subscripts mean left and right sides, respectively, Re { } and Im{ } are real and imaginary parts, respectively, and s is a fitting parameter. Current art requires transmission of the high-resolution band signals $X_L$ and $X_R$.

The prior methods teach using high bit-rate communications between the ears; however, it is not practical to transmit data at these high rates in current designs. Thus, the present subject matter provides a noise suppression technology available for systems using relatively low bit rates. The method essentially includes communication of lower-resolution values of the amplitude and phase, rather than the high-resolution band signals. Thus, the amplitude and phase information is already quantized, but the level of quantization is increased to allow for lower bit rate transfer of information from one hearing assistance device to the other.

FIG. 1A is a flow diagram 100 of a binaural noise reduction system for a hearing assistance device according to one embodiment of the present subject matter. The left hearing aid is used to demonstrate gain estimate for noise reduction, but it is understood that the same approach is practiced in the left and right hearing aids. In various embodiments the approach of FIG. 1A is performed in one of the left and right hearing aids, as will be discussed in connection with FIG. 1B. The methods taught here are not limited to a right or left hearing aid, thus references to a "left" hearing aid or signal can be reversed to apply to "right" hearing aid or signal.

In FIG. 1A a sound signal from one of the microphones 121 (e.g., the left microphone) is converted into frequency domain samples by frequency analysis block 123. The samples are represented by complex numbers 125. The complex numbers can be used to determine phase 127 and amplitude 129 as a function of frequency and sample (or time). In one approach, rather than transmitting the actual signals in each frequency band, the information in each band is first extracted ("Determine Phase" 127, "Determine Amplitude" 129), coded to a lower resolution ("Encode Phase" 131, "Encode Amplitude" 133), and transmitted to the other hearing aid 135 at a lower bandwidth than non-coded values, according to one embodiment of the present subject matter. The coded information from the right hearing aid is received at the left hearing aid 137 ("$QP_R$" and "$QA_R$"), mapped to a original dynamic range 139 ("$P_R$" and "$A_R$") and used to compute a gain estimate 141. In various embodiments the gain estimate $G_L$ is smoothed 143 to produce a final gain.

The "Compute Gain Estimate" block 141 acquires information from the right side aid ($P_R$ and $A_R$) using the coded information. In one example, the coding process at the left hearing aid uses 2 bits as exemplified in the following pseudo-code for encoding the phase $P_L$:

If $P_L$<P1, $QP_L$=0, else

If $P_L$<P2, $QP_L$=1, else

If $P_L$<P3, $QP_L$=2, else $QP_L$=3.

Wherein P1-P4 represent values selected to perform quantization into quartiles. It is understood that any number of quantization levels can be encoded without departing from the scope of the present subject matter. The present encoding scheme is designed to reduce the amount of data transferred from one hearing aid to the other hearing aid, and thereby employ a lower bandwidth link. For example, another encoding approach includes, but is not limited to, the continuously variable slope delta modulation (CVSD or CVSDM) algorithm first proposed by J. A. Greefkes and K. Riemens, in "Code Modulation with Digitally Controlled Companding for Speech Transmission," Philips Tech. Rev., pp. 335-353, 1970, which is hereby incorporated by reference in its entirety. Another example is that in various embodiments, parameters P1-P4 are pre-determined. In various embodiments, parameters P1-P4 are determined adaptively online. Parameters determined online are transmitted across sides, but transmitted infrequently since they are assumed to change slowly. However, it is understood that in various applications, this can be done at a highly reduced bit-rate. In some embodiments P1-P4 are determined from a priori knowledge of the variations of phase and amplitude expected from the hearing device. Thus, it is understood that a variety of other encoding approaches can be used without departing from the scope of the present subject matter.

The mapping of the coded values from the right hearing aid back to the high resolution at the left hearing aid is exemplified in the following pseudo-code for the phase $QP_R$:

If $QP_R=0$, $P_R=(P1)/2$, else

If $QP_R=1$, $P_R=(P2+P1)/2$, else

If $QP_R=2$, $P_R=(P3+P2)/2$, else $P_R$=P4.

These numbers, P1-P4, (or any number of parameters for different levels of quantization) reflect the average data needed to convert the variational amplitude and phase information into the composite valued signals for both.

In one example, the coding process at the left hearing aid uses 2 bits as exemplified in the following pseudo-code for quantizing the amplitude $A_L$:

If $A_L$<P1, $QA_L$=0, else

If $A_L$<P2, $QA_L$=1, else

If $A_L$<P3, $QA_L$=2, else $QA_L$=3.

And accordingly, the mapping of the coded values from the right hearing aid back to the high resolution at the left hearing aid is exemplified in the following pseudo-code for the coded amplitude $QA_R$:

If $QA_R=0$, $A_R=(P1)/2$, else

If $QA_R=1$, $A_R=(P2+P1)/2$, else

If $QA_R=2$, $A_R=(P3+P2)/2$, else $A_R$=P4.

The P1-P4 parameters represent values selected to perform quantization into quartiles. It is understood that any number of quantization levels can be encoded without departing from the scope of the present subject matter. The present encoding scheme is designed to reduce the amount of data transferred from one hearing aid to the other hearing aid, and thereby employ a lower bandwidth link. For example, another coding approach includes, but is not limited to, the continuously variable slope delta modulation (CVSD or CVSDM) algorithm first proposed by J. A. Greefkes and K. Riemens, in "Code Modulation with Digitally Controlled Companding for Speech Transmission," Philips Tech. Rev., pp. 335-353, 1970, which is hereby incorporated by reference in its entirety. Another example is that in various embodiments, parameters P1-P4 are pre-determined. In various embodiments, parameters P1-P4 are determined adaptively online. Parameters determined online are transmitted across sides, but transmitted infrequently. However, it is understood that in various applications, this can be done at a highly reduced bit-rate. In some embodiments P1-P4 are determined from a priori knowledge of the variations of phase and amplitude expected from the hearing device. Thus, it is understood that a variety of other quantization approaches can be used without departing from the scope of the present subject matter.

In the embodiment of FIG. 1A it is understood that a symmetrical process is executed on the right hearing aid which receives data from the left hearing aid symmetrically to what was just described above.

Once the phase and amplitude information from both hearing aids is available, the processor can use the parameters to compute the gain estimate G(t) using the following equations:

$$A_L(t) = \sqrt{\mathrm{Re}^2\{X_L(t)\} + \mathrm{Im}^2\{X_L(t)\}}$$

$$A_R(t) = \sqrt{\mathrm{Re}^2\{X_R(t)\} + \mathrm{Im}^2\{X_R(t)\}}$$

$$P_L(t) = \tan^{-1}\left[\frac{\mathrm{Im}\{X_L(t)\}}{\mathrm{Re}\{X_L(t)\}}\right]$$

-continued $$P_R(t) = \tan^{-1}\left[\frac{\mathrm{Im}\{X_R(t)\}}{\mathrm{Re}\{X_R(t)\}}\right]$$

$$G(t) = \max\left\{G_{mib}, \left[\frac{2 \cdot A_L(t) \cdot A_R(t) \cdot \cos(P_L(t) - P_R(t))}{A_L^2(t) + A_R^2(t)}\right]^s\right\}$$

The equations above provide one example of a calculation for quantifying the difference between the right and left hearing assistance devices. Other differences may be used to calculate the gain estimate. For example, the methods described by Peissig and Kollmeier in "Directivity of binaural noise reduction in spatial multiple noise-source arrangements for normal and impaired listeners," J. Acoust. Soc. Am. 101, 1660-1670, (1997), which is incorporated by reference in its entirety, can be used to generate differences between right and left devices. Thus, such methods provide additional ways to calculate differences between the right and left hearing assistance devices (e.g., hearing aids) for the resulting gain estimate using the lower bit rate approach described herein. It is understood that yet other difference calculations are possible without departing from the scope of present subject matter. For example, when the target is not expected to be from the front it is possible to calculate gain based on how well the differences between left and right received signals match the differences expected for sound coming from the known, non-frontal target direction. Other calculation variations are possible without departing from the scope of the present subject matter.

Figure 1B:
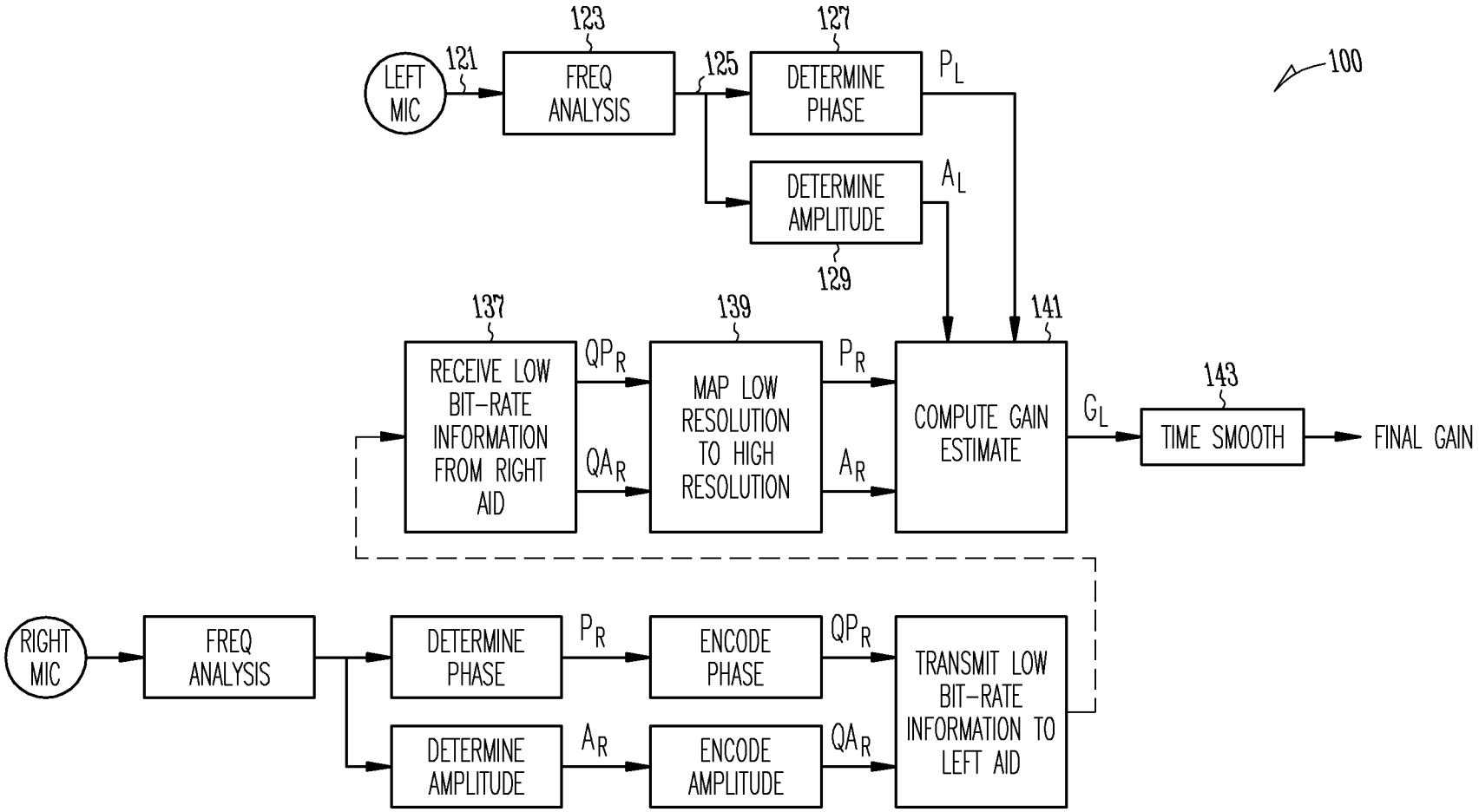
FIG. 1B is a flow diagram of a noise reduction system for a hearing assistance device according to one embodiment of the present subject matter.

FIG. 1B is a flow diagram of a noise reduction system for a hearing assistance device according to one embodiment of the present subject matter. In this system, the only hearing aid performing a gain calculation is the left hearing aid. Thus, several blocks can be omitted from the operation of both the left and right hearing aids in this approach. Thus, blocks 131, 135, and 133 can be omitted from the left hearing aid because the only aid performing a gain adjustment is the left hearing aid. Accordingly, the right hearing aid can perform blocks equivalent to 123, 127, 129, 131, 133, and 135 to provide coded information to the left hearing aid for its gain calculation. The remaining processes follow as described above for FIG. 1A. FIG. 1B demonstrates a gain calculation in the left hearing aid, but it is understood that the labels can be reversed to perform gain calculations in the right hearing aid.

It is understood that in various embodiments the process blocks and modules of the present subject matter can be performed using a digital signal processor, such as the processor of the hearing aid, or another processor. In various embodiments the information transferred from one hearing assistance device to the other uses a wireless connection. Some examples of wireless connections are found in U.S. patent application Ser. Nos. 11/619,541, 12/645,007, and 11/447,617, all of which are hereby incorporated by reference in their entirety. In other embodiments, a wired ear-to-ear connection is used.

Figure 2:
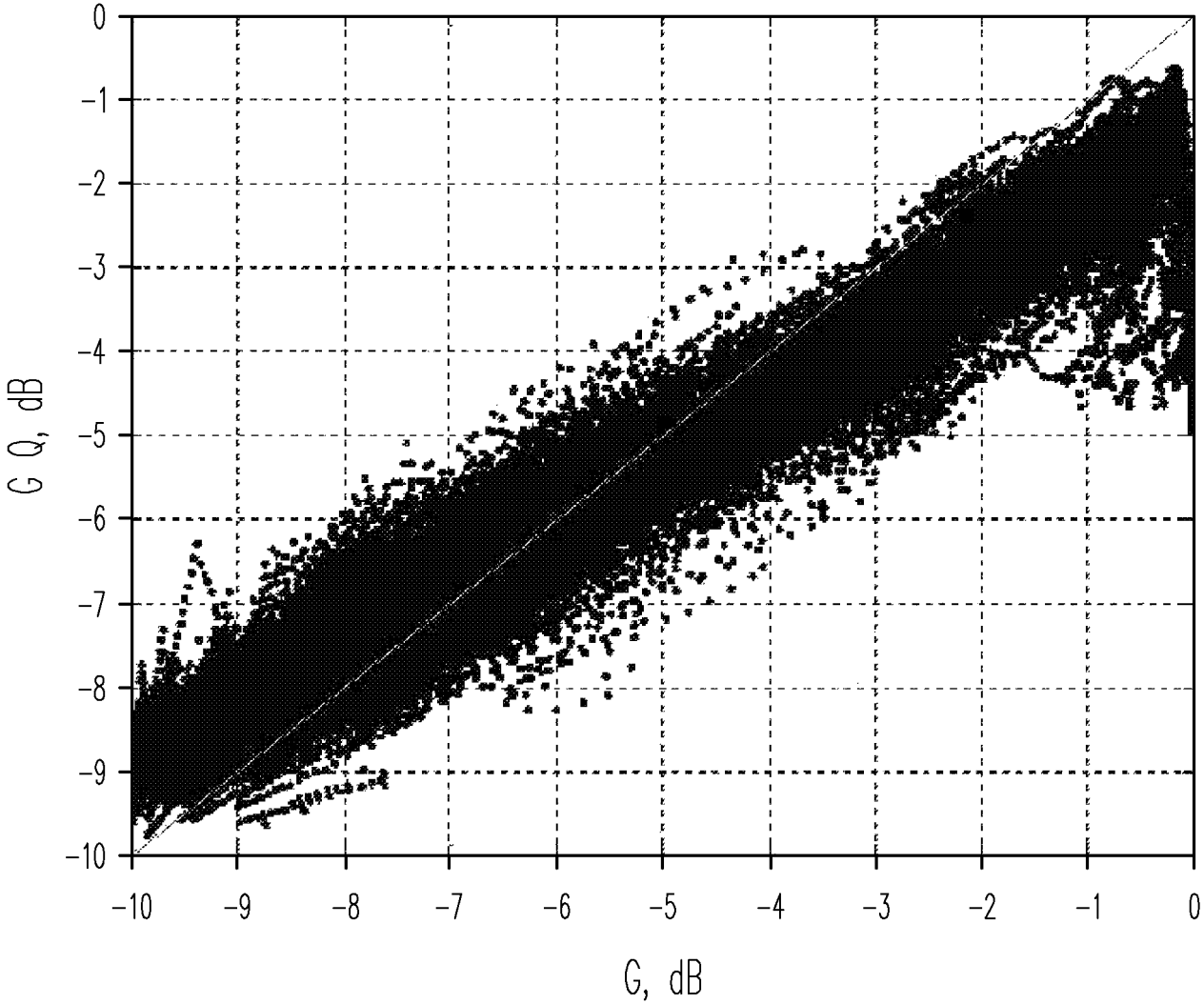
FIG. 2 is a scatterplot showing 20 seconds of gain in a 500-Hz band computed with high-resolution information ("G", x axis) and the gain computed with coded information from one side ("G Q", y axis), using a noise reduction system according to one embodiment of the present subject matter.
Figure 3:
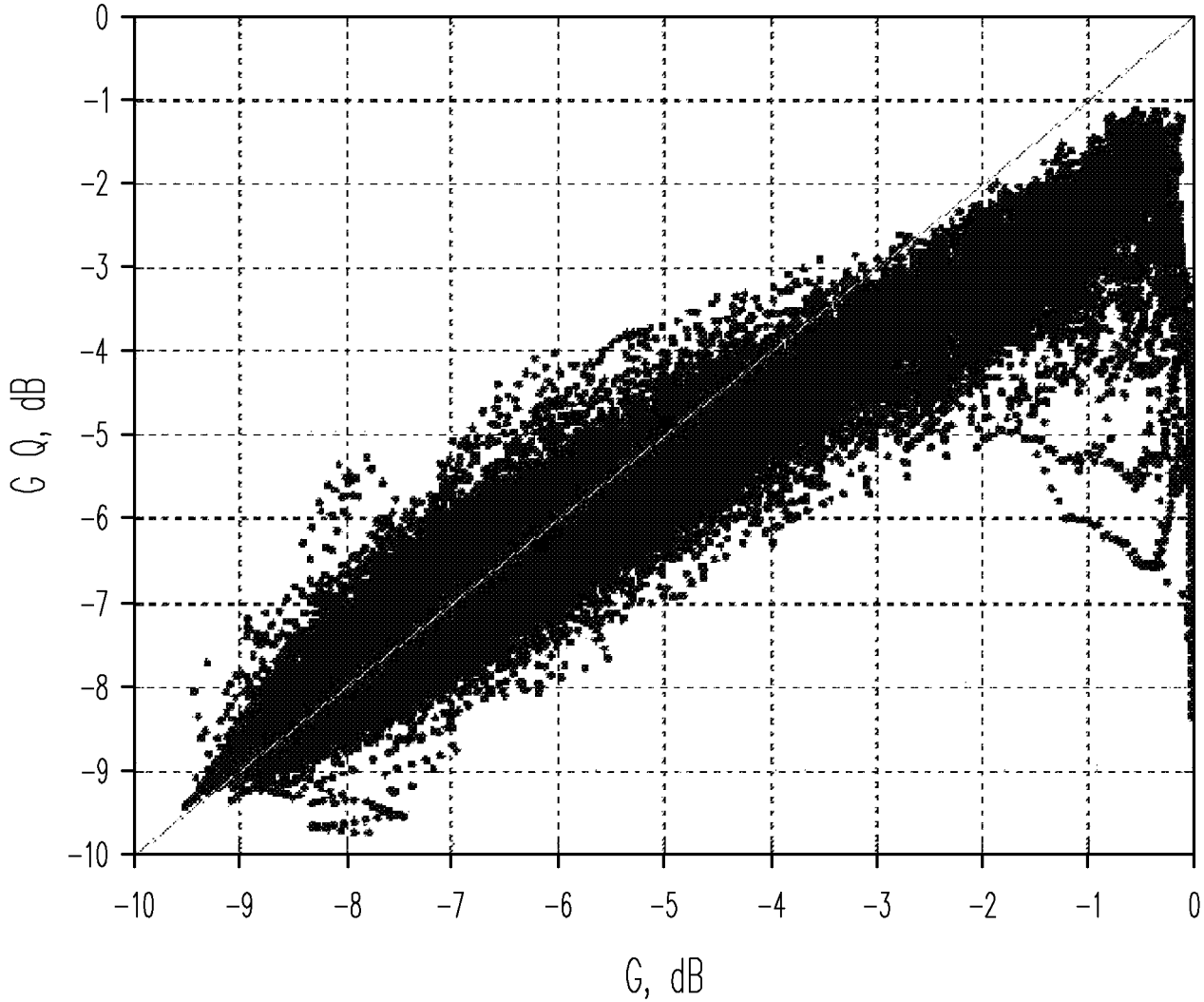
FIG. 3 is a scatterplot showing 20 seconds of gain in a 4 KHz band computed with high-resolution information ("G", x axis) and the gain computed with coded information from one side ("G Q", y axis), using a noise reduction system according to one embodiment of the present subject matter.

FIG. 2 is a scatter plot of 20 seconds of gain in a 500-Hz band computed with high-resolution information ("G", x axis) and the gain computed with coded information from one side ("G Q", y axis). Coding was to 2 bits for amplitude and phase. The target was TIMIT sentences, the noise was the sum of a conversation presented at 140 degrees (5 dB below the target level) and uncorrelated noise at the two microphones (10 dB below the target level) to simulate reverberation. FIG. 3 shows the same information as the system of FIG. 2, except for a 4 KHz band. It can be seen that the two gains are highly correlated. Variance from the diagonal line at high and low gains is also apparent, but this can be compensated for in many different ways. The important point is that, without any refinement of the implementation of the basic idea, a gain highly correlated with the full-information gain can be computed from 2-bit coded amplitude and phase information.

Many different coding/mapping schemes can be used without departing from the scope of the present subject matter. For instance, alternate embodiments include transmitting primarily the coded change in information from frame-to-frame. Thus, phase and amplitude information do not need to be transmitted at full resolution for useful noise reduction to occur.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having a receiver-in-the-canal (RIC) or receiver-in-the-ear (RITE) designs. It is understood that other hearing assistance devices not expressly stated herein may fall within the scope of the present subject matter It is understood one of skill in the art, upon reading and understanding the present application will appreciate that variations of order, information or connections are possible without departing from the present teachings. This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A system for binaural noise reduction, the system comprising:

a first hearing assistance device configured to be worn in a first ear of a wearer; and a second hearing assistance device configured to be worn in a second ear of the wearer, wherein the first hearing assistance device includes a first processor configured to compute a first gain estimate for a first sound played at the first ear using first noise reduction calculations based on a first received sound at the first hearing assistance device, combined with second coded noise reduction calculations based on a second sound received at the second hearing assistance device, the second coded noise reduction calculations transferred wirelessly from the second hearing assistance device at a bit rate that is reduced by increasing a level of quantization from a rate necessary to transmit the information prior to coding.

2. The system of claim 1, wherein the second hearing assistance device includes a second processor configured to compute a second gain estimate for a second sound played at the second ear using second noise reduction calculations based on a second received sound at the second hearing assistance device, combined with first coded noise reduction calculations based on the first received sound at the first hearing assistance device, the first coded noise reduction calculations transferred wirelessly from the first hearing assistance device at a bit rate that is reduced by increasing a level of quantization from a rate necessary to transmit the information prior to coding.

3. The system of claim 1, wherein the first processor is configured to perform processing to compensate for hearing impairment.

4. The system of claim 2, wherein the second processor is configured to perform processing to compensate for hearing impairment.

5. The system of claim 2, wherein the first processor is configured to perform a quartile quantization to produce first coded noise reduction calculations.

6. The system of claim 2, wherein the second processor is configured to perform a quartile quantization to produce second coded noise reduction calculations.

7. The system of claim 1, wherein at least one of the first hearing assistance device and the second hearing assistance device is a hearing aid.

8. The system of claim 1, wherein at least one of the first hearing assistance device and the second hearing assistance device is a cochlear implant.

9. The system of claim 7, wherein the hearing aid includes an in-the-ear (ITE) hearing aid.

10. The system of claim 7, wherein the hearing aid includes a behind-the-ear (BTE) hearing aid.

11. The system of claim 7, wherein the hearing aid includes an in-the-canal (ITC) hearing aid.

12. The system of claim 7, wherein the hearing aid includes a receiver-in-canal (RIC) hearing aid.

13. The system of claim 7, wherein the hearing aid includes a completely-in-the-canal (CIC) hearing aid.

14. The system of claim 7, wherein the hearing aid includes a receiver-in-the-ear (RITE) hearing aid.

15. A method, comprising:

performing first noise reduction calculations based on a first received sound at a first hearing assistance device;

wirelessly receiving second coded noise reduction calculations based on a second sound received at the second hearing assistance device, the second coded noise reduction calculations received at a bit rate that is reduced by increasing a level of quantization from a rate necessary to transmit the information prior to coding;

decoding the second coded noise reduction calculations; and computing a first gain estimate for a first sound played at a first ear of a wearer using the first noise reduction calculations and the decoded second noise reduction calculations.

16. The method of claim 15, wherein performing first noise reduction calculations includes converting the first received sound into first side complex frequency domain samples, including phase and amplitude information.

17. The method of claim 16, comprising coding phase and amplitude information to produce coded phase and amplitude information.

18. The method of claim 17, wherein the coding includes generating a quartile quantization.

19. The method of claim 17, wherein the coding includes continuously variable slope delta modulation coding.

20. The method of claim 15, wherein decoding the second coded noise reduction calculations includes converting the second coded noise reduction calculations to original dynamic range information.

* * * * *